US012310427B2

(12) United States Patent
Fink

(10) Patent No.: US 12,310,427 B2
(45) Date of Patent: May 27, 2025

(54) CLOSURE APPARATUS

(71) Applicant: Fastech Asia Worldwide, Ltd., Cheung Sha Wan (CN)

(72) Inventor: Matthew Fink, Weston, MA (US)

(73) Assignee: Fastech Asia Worldwide, Ltd., Cheung Sha Wan (CN)

( * ) Notice: Subject to any disclaimer, the term of this patent is extended or adjusted under 35 U.S.C. 154(b) by 85 days.

(21) Appl. No.: 18/082,951

(22) Filed: Dec. 16, 2022

(65) Prior Publication Data

US 2024/0196999 A1 Jun. 20, 2024

(51) Int. Cl.
*A41C 3/00* (2006.01)
*A44B 11/04* (2006.01)

(52) U.S. Cl.
CPC ..... *A41C 3/0028* (2013.01); *A44B 11/04* (2013.01)

(58) Field of Classification Search
CPC ..... A44B 11/04; A41C 3/0028
See application file for complete search history.

(56) References Cited

U.S. PATENT DOCUMENTS 302,421 A * 7/1884 Mosier ..... A41B 11/002 24/578.16
796,414 A * 8/1905 Chayes ..... A41F 3/02 24/627
1,376,613 A 5/1921 Forsell
2,522,109 A 9/1950 Foltis
2,912,984 A 11/1959 Jensen
2,956,324 A * 10/1960 Klein ..... A44B 11/2596 24/702
3,165,803 A * 1/1965 Gaylord ..... A44B 11/2526 D11/216
3,200,464 A 8/1965 Cousins
3,979,801 A * 9/1976 Tareau ..... A41F 1/006 24/DIG. 43

(Continued)

FOREIGN PATENT DOCUMENTS

AT 341973 B 3/1978
AT 344113 B 7/1978

(Continued)

OTHER PUBLICATIONS http://img.alibaba.com/img/pb/961/652/269/1286195738435_hz-fileserver1_6501131.jpg, retrieved on Jun. 27, 2014.

(Continued)

*Primary Examiner* — David M Upchurch
(74) *Attorney, Agent, or Firm* — Pryor Cashman LLP

(57) ABSTRACT

A garment and associated closure including a male closure member including a first loop, an arm, and a bar; a female closure member including a second loop and a base portion including a top edge, a bottom edge, a blind hole into which the bar of the male closure member is insertable at the top edge and moveable along and configured for rotational pivoting of the bar in the blind hole, a recess configured to receive the arm of the male closure member upon rotational pivoting of the bar in the blind hole, and two protrusions extending from the recess and configured to reversibly secure the arm of the male closure member between the two protrusions upon rotational pivoting of the bar in the blind hole; and a nylon coating disposed on at least a portion of the male closure member or the female closure member.

20 Claims, 7 Drawing Sheets

(56) References Cited

U.S. PATENT DOCUMENTS

| | | | | | |
|---|---|---|---|---|---|
| 4,000,544 | A | | 1/1977 | Fildan | |
| 4,052,774 | A | * | 10/1977 | Noda | A44B 11/2588 24/DIG. 38 |
| 4,054,972 | A | * | 10/1977 | Rowell | A41C 3/02 24/698.2 |
| 4,161,806 | A | * | 7/1979 | Hennisse | A41F 1/006 24/594.11 |
| D274,293 | S | * | 6/1984 | Goepfer | D11/212 |
| 4,539,736 | A | * | 9/1985 | Yokosuka | A44C 5/2042 24/574.1 |
| 4,648,161 | A | * | 3/1987 | Rosen | A44C 5/2085 24/644 |
| D352,678 | S | | 11/1994 | Fildan | |
| 5,377,394 | A | * | 1/1995 | Fildan | A44B 11/2588 24/616 |
| 5,380,238 | A | | 1/1995 | Crew-Gee | |
| 5,671,516 | A | * | 9/1997 | Sartori | A44B 11/2515 24/579.11 |
| D398,881 | S | | 9/1998 | France-Davis | |
| 6,009,604 | A | | 1/2000 | Fildan | |
| D440,905 | S | * | 4/2001 | Fildan | D11/218 |
| 6,389,653 | B1 | * | 5/2002 | Matoba | A44B 11/006 24/615 |
| 6,859,982 | B1 | | 3/2005 | Carrillo | |
| D621,742 | S | * | 8/2010 | Paik | D11/200 |
| 8,375,615 | B2 | * | 2/2013 | Cameron | B43M 15/00 24/711.4 |
| 8,857,019 | B1 | * | 10/2014 | Nykoluk | A44B 11/2596 24/615 |
| D732,423 | S | * | 6/2015 | Fildan | D11/218 |
| 9,599,133 | B2 | * | 3/2017 | Gordon | F16B 2/02 |
| 9,635,919 | B2 | * | 5/2017 | Fiedler | A45C 13/10 |
| 9,756,906 | B1 | * | 9/2017 | Fink | A41F 1/006 |
| 9,918,521 | B1 | | 3/2018 | Fink | |
| 10,045,595 | B2 | * | 8/2018 | Vaccaro | A44B 17/0047 |
| 10,051,984 | B2 | * | 8/2018 | Buerck | A47G 25/90 |
| 10,092,051 | B2 | * | 10/2018 | Fildan | A41F 1/006 |
| 10,251,453 | B2 | * | 4/2019 | Ritchie | A44B 11/2596 |
| 10,316,887 | B2 | * | 6/2019 | Iannello | F16B 7/00 |
| 10,362,837 | B1 | * | 7/2019 | Fink | A44B 11/2596 |
| 11,375,778 | B1 | * | 7/2022 | Zinnbauer | A44B 11/2592 |
| 2002/0095752 | A1 | * | 7/2002 | Fildan | A41F 1/006 24/586.11 |
| 2016/0113341 | A1 | * | 4/2016 | Fildan | A44B 11/2596 450/91 |

FOREIGN PATENT DOCUMENTS

| | | | |
|---|---|---|---|
| CN | 1298283 | A | 6/2001 |
| CN | 205884700 | U | 1/2017 |
| CN | 207492152 | U | 6/2018 |
| CN | 214432123 | U | 10/2021 |

OTHER PUBLICATIONS

Written Opinion of the International Searching Authority in PCT/IB2023/000734 (Jul. 3, 2024).

International Search Report in PCT/IB2023/000734 (Jul. 3, 2024).

* cited by examiner

CLOSURE APPARATUS

TECHNICAL FIELD

The present invention relates generally to closures, and particularly to closures for reversibly securing two items to one another.

BACKGROUND OF THE INVENTION

Although closures for reversibly securing two items are known in the prior art, the present invention represents an improved configuration for securement over existing closures.

SUMMARY OF THE INVENTION

It is an object of the present invention to provide a closure mechanism that provides for reversibly securing two items. The invention is applicable to any application that requires a closure to reversibly secure two items. For example, the present invention is applicable to the field of garments and apparel, such as the center gore for brassieres.

In general, in one aspect, the invention features a closure including a male closure member including a first loop, an arm fixedly attached to the first loop, and a bar fixedly attached to the arm, the bar having an upper portion extending orthogonally from the arm in a first direction and a lower portion extending orthogonally from the arm in a second direction opposite the first direction; a female closure member including a second loop and a base portion fixedly attached to the second loop, the base portion including a top edge, a bottom edge, a blind hole extending from the top edge toward the bottom edge into which the bar of the male closure member is insertable at the top edge and moveable along and configured for rotational pivoting of the bar in the blind hole, a recess configured to receive the arm of the male closure member upon rotational pivoting of the bar in the blind hole, and two protrusions extending from the recess and configured to reversibly secure the arm of the male closure member between the two protrusions upon rotational pivoting of the bar in the blind hole; and a nylon coating disposed on at least a portion of the male closure member or the female closure member.

Implementations of the invention may include one or more of the following features. The nylon coating may be disposed on both of the male closure member and the female closure member. Additionally, the nylon coating may be disposed on an entirety of both of the male closure member and the female closure member. The nylon coating may be a polyamide/nylon 11 powder coating. One or both of the two protrusions may house a click insert or a snap insert to further secure the arm of the male closure member upon rotational pivoting of the bar in the blind hole. Additionally, the click insert or the snap insert may be formed from plastic. The male closure member and/or the female closure member may be formed from metal or plastic.

In general, in another aspect, the invention features a garment including a closure including a male closure member including a first loop, an arm fixedly attached to the first loop, and a bar fixedly attached to the arm, the bar having an upper portion extending orthogonally from the arm in a first direction and a lower portion extending orthogonally from the arm in a second direction opposite the first direction; a female closure member including a second loop and a base portion fixedly attached to the second loop, the base portion including a top edge, a bottom edge, a blind hole extending from the top edge toward the bottom edge into which the bar of the male closure member is insertable at the top edge and moveable along and configured for rotational pivoting of the bar in the blind hole, a recess configured to receive the arm of the male closure member upon rotational pivoting of the bar in the blind hole, and two protrusions extending from the recess and configured to reversibly secure the arm of the male closure member between the two protrusions upon rotational pivoting of the bar in the blind hole; and a nylon coating disposed on at least a portion of the male closure member or the female closure member.

Implementations of the invention may include one or more of the following features. The nylon coating may be disposed on both of the male closure member and the female closure member. Additionally, the nylon coating may be disposed on an entirety of both of the male closure member and the female closure member. The nylon coating may be a polyamide/nylon 11 powder coating. One or both of the two protrusions may house a click insert or a snap insert to further secure the arm of the male closure member upon rotational pivoting of the bar in the blind hole. Additionally, the click insert or the snap insert may be formed from plastic. The male closure member and/or the female closure member may be formed from metal or plastic. The garment may be a brassiere. Additionally, the closure may be configured as a center gore of the brassiere, a shoulder strap attachment of the brassiere, or a back band attachment of the brassiere.

BRIEF DESCRIPTION OF THE DRAWINGS

The above-mentioned and other aspects, features, and advantages can be more readily understood from the following detailed description with reference to the accompanying drawings wherein.

DETAILED DESCRIPTION OF THE INVENTION

Figure 1:
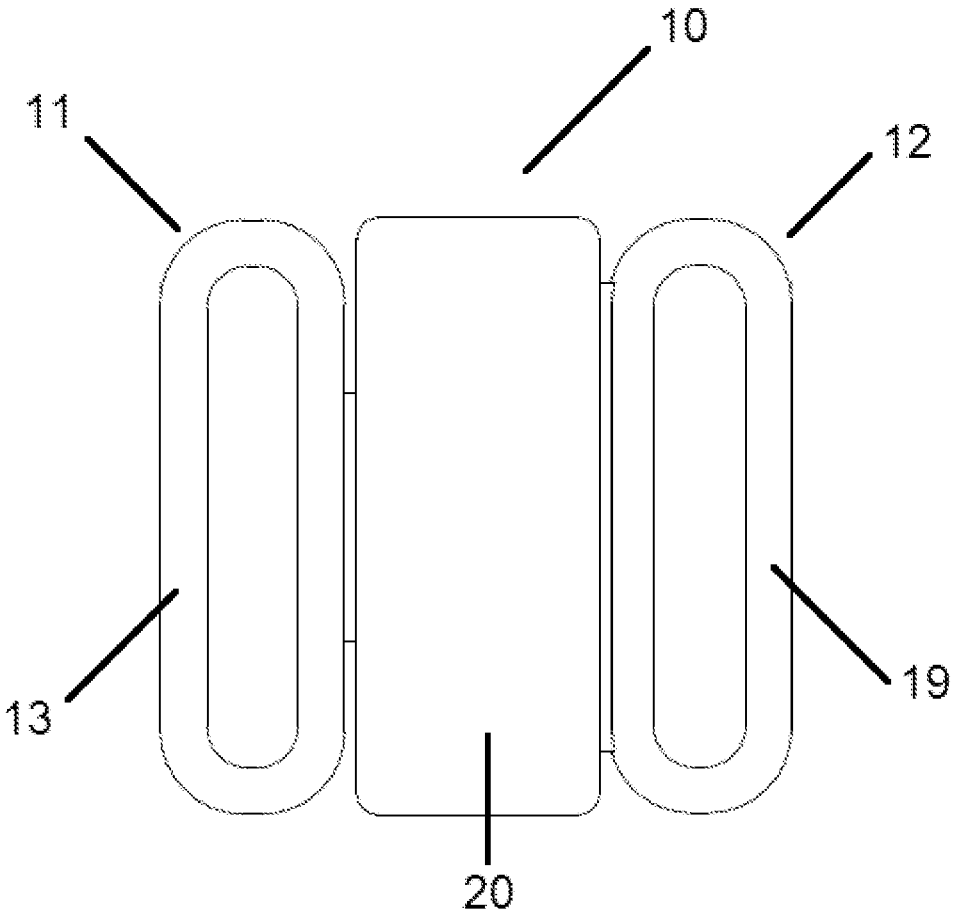
FIG. 1 shows a front view of a closure apparatus with the closure members secured according to an embodiment of the present invention.
Figure 2:
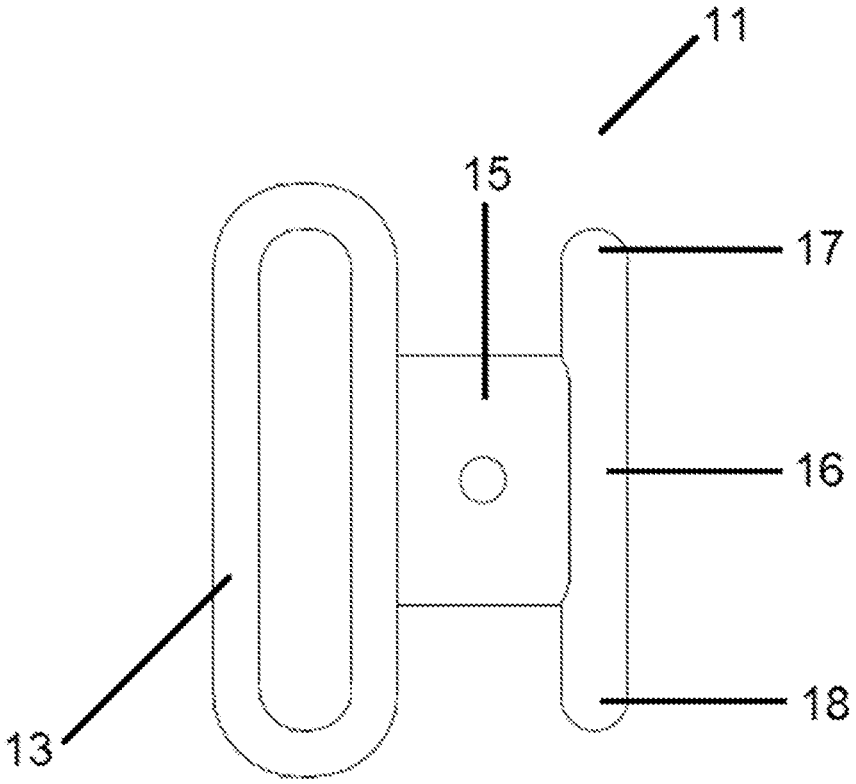
FIG. 2 shows a front view of the male closure member of the closure apparatus of FIG. 1.
Figure 3:
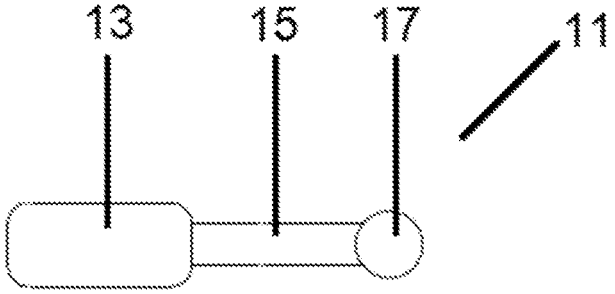
FIG. 3 shows a top view of the male closure member of the closure apparatus of FIG. 1.
Figure 4:
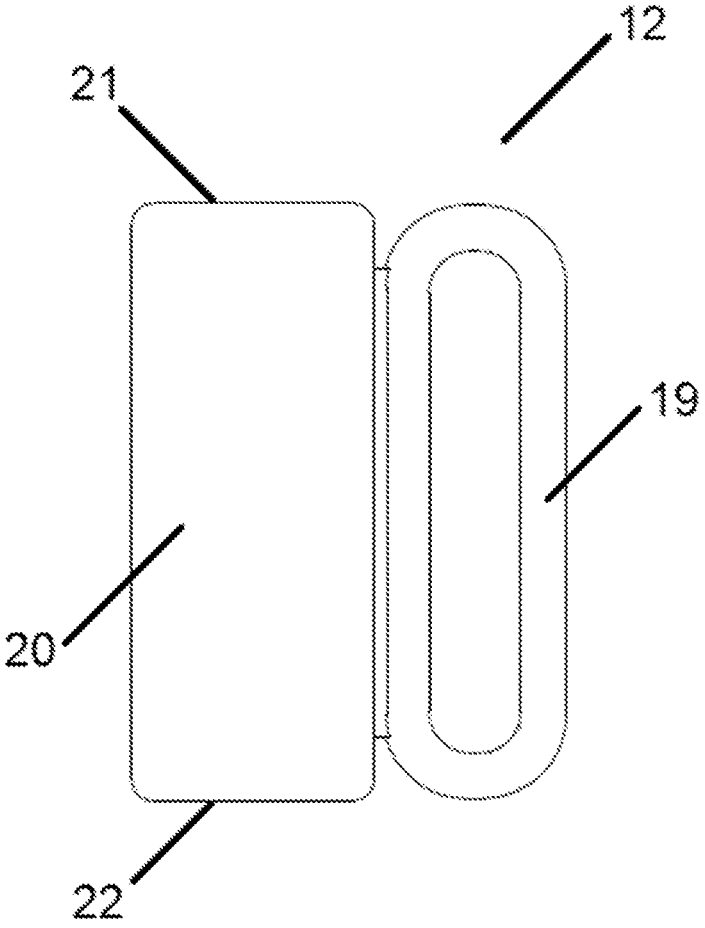
FIG. 4 shows a front view of the female closure member of the closure apparatus of FIG. 1.
Figure 5:
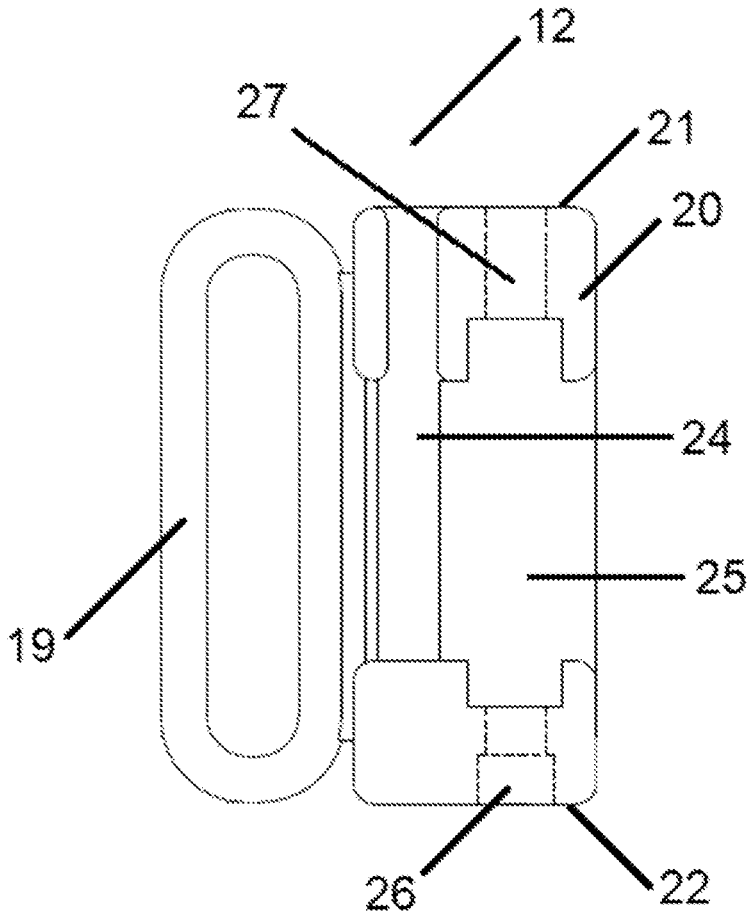
FIG. 5 shows a back view of the female closure member of the closure apparatus of FIG. 1.
Figure 6:
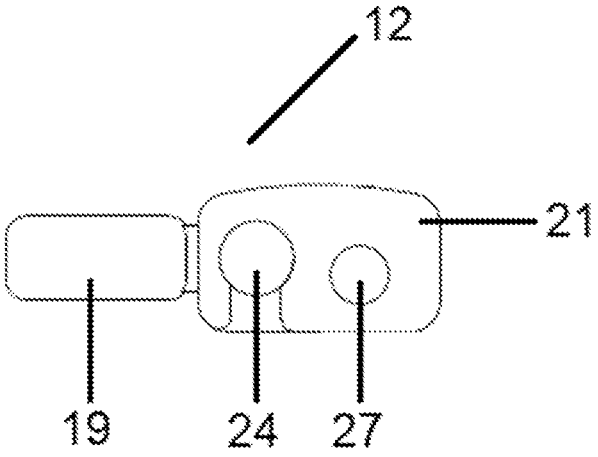
FIG. 6 shows a top view of the female closure member of the closure apparatus of FIG. 1.
Figure 7:
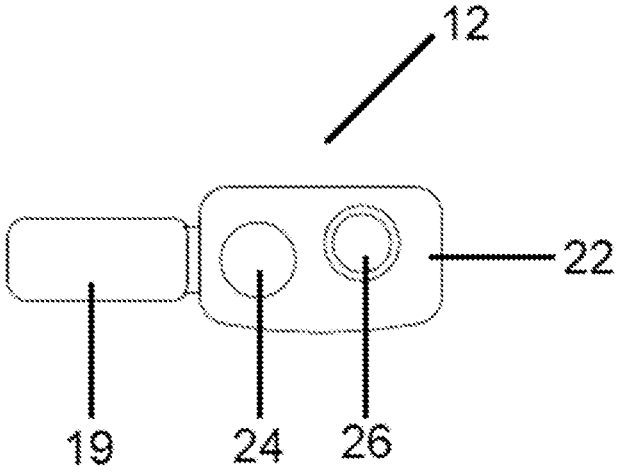
FIG. 7 shows a bottom view of the female closure member of the closure apparatus of FIG. 1.

The present invention provides a closure 10 for reversibly securing two items together, as shown in FIGS. 1-7. Closure 10 includes two components, namely a male closure member 11 and a female closure member 12.

Male closure member 11 includes a first loop 13, an arm 15 that is fixedly attached to first loop 13, and a bar 16 that is fixedly attached to arm 15. Bar 16 has an upper portion 17 and a lower portion 18 which extend orthogonally from the arm in opposite directions. First loop 13, arm 15, and bar 16 lie substantially in the same plane.

Female closure member 12 includes a second loop 19 and a base portion 20 that is fixedly attached to second loop 19.

Base portion 20 has a top edge 21 and a bottom edge 22. Top edge 21 has a blind hole 24, which extends from top edge 21 toward bottom edge 22.

Bar 16 of male closure member 11 can be inserted into blind hole 24 at top edge 21 and slid along blind hole 24 toward bottom edge 22. Upon complete insertion, lower portion 18 of bar 16 rests at a bottom portion of blind hole 24. Base portion 20 includes a recess 25 for receiving arm 15. Base portion 20 also includes resilient protrusion apertures 26 and 27 that extend therefrom and configured to removably secure arm 15 of male closure member 11 to female closure member 12 upon insertion and rotation of bar 16 in blind hole 24, providing further securement of male closure member 11 with female closure member 12 when these elements are engaged. In particular, protrusion apertures 26 and 27 have sufficient resiliency such that arm 15 may pass across and over protrusion apertures 26 and 27 with minimal applied force and male closure member 11 will be held in place by protrusion apertures 26 and 27. Protrusion apertures 26 and 27 may house a click insert feature, a snap insert feature, or the like, plastic or otherwise, to assist in the reversible securement of arm 15 of male closure member 11.

Put differently, bar 16 of male closure member 11 may be inserted into blind hole 24 at top edge 21 of base portion 20 such that the plane of male closure member 11 is orthogonal to base portion 20 of female closure member 12. Bar 16 is slid along blind hole 24 until lower portion 18 of bar 16 rests at a bottom portion of blind hole 24. Male closure member 11 may then be rotatably pivoted about bar 16 so that male closure member 11 is substantially coplanar with base portion 20, arm 15 is received in recess 25, and arm 15 removably secured by protrusion apertures 26 and 27. The components of closure 10, including male closure member 11, female closure member 12, and protrusion apertures 26 and 27, may be made from any durable, non-deformable, and strong material. Such material may be a metal, such as steel, stainless steel, copper or brass, zinc alloy, or plastic. In a preferred embodiment, protrusion apertures 26 and 27 and components therein are plastic.

In a preferred embodiment of the present invention, closure 10 is coated in nylon. Male closure member 11 and female closure member 12 may be coated entirely or partially in nylon. The nylon coating may be a polyamide/nylon 11 powder coating, applied through an industry-accepted powder coating process. Alternatively, the nylon coating may be formed on closure 10, e.g., by spraying a nylon material on the closure or by dipping the closure in a liquid nylon material that dries and affixes to the closure. Such coating permits the coloration of closure 10, including through the use of dyes or by pre-coloration of the powder, e.g., to match the color of closure 10 to adjacent garment portions. Additionally, the nylon coating may have a smooth finish, which may also allow for further coatings or layers to be disposed or formed thereon.

The closure of the present invention may be configured as any industry-accepted size, including as measured by the length of the longitudinal space formed by a loop of a closure member, such as first loop 13 of male closure member 11 or second loop 19 of female closure member 12. In particular, non-limiting embodiments of the present invention, the closure may be configured such that the length of the longitudinal space formed by a loop of a closure member is 12 mm, 14 mm, 16 mm, or 22 mm.

Items can be removably secured to one another through attachment of one to first loop 13 of male closure member 11 and the other to second loop 19 of female closure member 12. For example, separate garment or apparel straps may be attached to first loop 13 and second loop 19, such as brassiere shoulder straps, brassiere back band portions, brassiere center gore portions, and the like.

FIGS. 1-7 illustrate varying views of closure 10 and its components.

The embodiments and examples above are illustrative, and many variations can be introduced to them without departing from the spirit of the disclosure or from the scope of the appended claims. For example, elements and/or features of different illustrative and exemplary embodiments herein may be combined with each other and/or substituted with each other within the scope of this disclosure. The objects of the invention, along with various features of novelty that characterize the invention, are pointed out with particularity in the claims annexed hereto and forming a part of this disclosure. For an understanding of the invention, its operating advances and the specific objects attained by its uses, reference should be had to the accompanying drawings and descriptive matter in which there is illustrated a preferred embodiment of the invention.

What is claimed is:

1. A closure comprising:

a male closure member comprising:

a first loop;

an arm fixedly attached to the first loop; and a bar fixedly attached to the arm, the bar having an upper portion extending orthogonally from the arm in a first direction and a lower portion extending orthogonally from the arm in a second direction opposite the first direction;

a female closure member comprising:

a second loop; and a base portion fixedly attached to the second loop, the base portion comprising:

a top edge;

a bottom edge;

a blind hole extending from the top edge toward the bottom edge into which the bar of the male closure member is insertable at the top edge and moveable along and configured for rotational pivoting of the bar in the blind hole;

a recess configured to receive the arm of the male closure member upon rotational pivoting of the bar in the blind hole; and two protrusions extending from the recess and configured to reversibly secure the arm of the male closure member between the two protrusions upon rotational pivoting of the bar in the blind hole; and a nylon coating disposed on at least a portion of the male closure member or the female closure member.

2. The closure of claim 1, wherein the nylon coating is disposed on both of the male closure member and the female closure member.

3. The closure of claim 2, wherein the nylon coating is disposed on an entirety of both of the male closure member and the female closure member.

4. The closure of claim 1, wherein the nylon coating is a polyamide/nylon 11 powder coating.

5. The closure of claim 1, wherein one or both of the two protrusions houses a click insert or a snap insert to further secure the arm of the male closure member upon rotational pivoting of the bar in the blind hole.

6. The closure of claim 5, wherein the click insert or the snap insert is formed from plastic.

7. The closure of claim 1, wherein the male closure member is formed from metal or plastic.

8. The closure of claim 1, wherein the female closure member is formed from metal or plastic.

9. A garment comprising:

a closure comprising:

a male closure member comprising:

a first loop;

an arm fixedly attached to the first loop; and a bar fixedly attached to the arm, the bar having an upper portion extending orthogonally from the arm in a first direction and a lower portion extending orthogonally from the arm in a second direction opposite the first direction;

a female closure member comprising:

a second loop; and a base portion fixedly attached to the second loop, the base portion comprising:

a top edge;

a bottom edge;

a blind hole extending from the top edge toward the bottom edge into which the bar of the male closure member is insertable at the top edge and moveable along and configured for rotational pivoting of the bar in the blind hole;

a recess configured to receive the arm of the male closure member upon rotational pivoting of the bar in the blind hole; and two protrusions extending from the recess and configured to reversibly secure the arm of the male closure member between the two protrusions upon rotational pivoting of the bar in the blind hole; and a nylon coating disposed on at least a portion of the male closure member or the female closure member.

10. The garment of claim 9, wherein the nylon coating is disposed on both of the male closure member and the female closure member.

11. The garment of claim 10, wherein the nylon coating is disposed on an entirety of both of the male closure member and the female closure member.

12. The garment of claim 9, wherein the nylon coating is a polyamide/nylon 11 powder coating.

13. The garment of claim 9, wherein one or both of the two protrusions houses a click insert or a snap insert to further secure the arm of the male closure member upon rotational pivoting of the bar in the blind hole.

14. The garment of claim 13, wherein the click insert or the snap insert is formed from plastic.

15. The garment of claim 9, wherein the male closure member is formed from metal or plastic.

16. The garment of claim 9, wherein the female closure member is formed from metal or plastic.

17. The garment of claim 9, wherein the garment is a brassiere.

18. The garment of claim 17, wherein the closure is configured as a center gore of the brassiere.

19. The garment of claim 17, wherein the closure is configured as a shoulder strap attachment of the brassiere.

20. The garment of claim 17, wherein the closure is configured as a back band attachment of the brassiere.

* * * * *